US006986230B2

(12) United States Patent
Schipani et al.

(10) Patent No.: US 6,986,230 B2
(45) Date of Patent: Jan. 17, 2006

(54) FOLDABLE SUPPORT STRUCTURE WITH HINGED WALL MEMBERS

(75) Inventors: Ralph L. Schipani, Edina, MN (US); Richard K. Strayer, Andover, MN (US); Mark Brauer, Minneapolis, MN (US); Paul Miklautsch, Shakopee, MN (US); Patrick M. Hamilton, Golden Valley, MN (US); Shaohui Qiu, Minneapolis, MN (US)

(73) Assignee: Eagle Development Corporation, Minneapolis, MN (US)

( * ) Notice: Subject to any disclaimer, the term of this patent is extended or adjusted under 35 U.S.C. 154(b) by 0 days.

(21) Appl. No.: 10/649,344

(22) Filed: Aug. 27, 2003

(65) Prior Publication Data

US 2004/0111999 A1 Jun. 17, 2004

Related U.S. Application Data

(63) Continuation-in-part of application No. 10/186,285, filed on Jun. 28, 2002, now Pat. No. 6,715,255.

(51) Int. Cl.
*E04C 3/02* (2006.01)

(52) U.S. Cl. ..... 52/694; 52/646; 211/199

(58) Field of Classification Search ..... 52/637, 52/638, 645, 646, 648.1, 694, 652.1, 653.1, 52/653.2; 211/195, 198, 199; 446/115, 116
See application file for complete search history.

(56) References Cited

U.S. PATENT DOCUMENTS 1,140,448 A * 5/1915 Ellinger ..... 52/646
2,987,148 A * 6/1961 Reeson ..... 52/111
3,011,586 A * 12/1961 Harvey Jr. ..... 182/115
3,908,564 A 9/1975 Miller et al.
4,280,310 A * 7/1981 Tolliver ..... 52/646
4,986,016 A 1/1991 Wichman
5,016,418 A 5/1991 Rhodes et al.
5,701,713 A 12/1997 Silver
5,822,945 A 10/1998 Muller
5,900,850 A 5/1999 Bailey et al.
6,026,626 A 2/2000 Fisher
6,076,770 A 6/2000 Nygren et al.
6,149,021 A * 11/2000 Beaulieu ..... 211/201
6,219,009 B1 4/2001 Shipley et al.
6,219,974 B1 4/2001 Hoberman
6,233,881 B1 5/2001 Rainbolt
6,240,940 B1 6/2001 Carter
6,244,010 B1 6/2001 Sluiter
6,253,520 B1 7/2001 Houk
6,260,327 B1 7/2001 Pellock
6,266,030 B1 7/2001 Warren et al.

(Continued)

FOREIGN PATENT DOCUMENTS

WO WO 00/53861 9/2000

*Primary Examiner*—Naoko Slack
(74) *Attorney, Agent, or Firm*—Altera Law Group, LLC

(57) ABSTRACT

A foldable truss member suitable for commercial displays includes a plurality of side members that are hingedly connected together. The side members include support members and bridging members having extensions. The side members are joined into a foldable structure with a hinge member between the support member and extensions of adjacent side members. The truss includes frictional hinge surfaces that hold the truss member in a deployed configuration. A display structure can be formed by connecting a locking frame between two truss members.

18 Claims, 5 Drawing Sheets

U.S. PATENT DOCUMENTS 6,276,095 B1 8/2001 Tripsianes
6,276,521 B1 8/2001 Arndt et al.
6,283,136 B1 9/2001 Chen
6,293,500 B1 9/2001 Bigelow
6,296,077 B1 10/2001 Wood et al.
6,296,109 B1 10/2001 Nohl

* cited by examiner

FOLDABLE SUPPORT STRUCTURE WITH HINGED WALL MEMBERS

CROSS REFERENCE TO RELATED APPLICATION

This is a continuation-in-part of non-provisional application Ser. No. 10/186,285, filed Jun. 28, 2002 now U.S. Pat. No. 6,715,255.

BACKGROUND OF THE INVENTION

1. Field of the Invention

The present invention relates to portable support structures for use in temporary fixtures such as trade shows and conventions, and particularly to a portable folding truss system having hinged side elements.

2. Description of Related Art

Commercial displays such as those used in trade show booths require strong structures that can be easily transported and configurable in a wide variety of forms. Such structures need to be lightweight, portable, and able to be quickly set up and broken down.

Prior art solutions have utilized truss members with folding elements that utilize rigid wall members coupled with rotatable wall members. The rotatable side members allow the truss to collapse. The trusses include internal diagonal pivoting members that serve to lock the truss into an open position. Although useful in some applications, this approach has deficiencies.

Using differently designed rigid and rotatable wall members as in prior art solutions increases the inventory of piece parts needed to build the truss, thereby making the truss more complicated and expensive to manufacture. Also, the non-symmetry of the assembled structure (due to the non-rigidity of the rotatable wall members) gives such a truss non-uniform load bearing characteristics when deployed horizontally. Therefore, if the user is not careful and/or cognizant of the requirement for a certain orientation, a structure according to the prior art design might be deployed in an unsafe manner with potentially catastrophic results.

It can be seen that there is a need for a collapsible/foldable truss member that is strong, easily fabricated and assembled into a temporary or permanent structure for a commercial display or other structural application. Further, a truss member that can be configured to provide horizontal support regardless of the truss member's orientation is also needed. The present invention fulfills these and other needs, and addresses other deficiencies of prior art implementations.

SUMMARY OF THE INVENTION

To overcome the limitations in the prior art described above, and to overcome other limitations that will become apparent upon reading and understanding the present specification, the present invention discloses a portable support structure for use in a temporary or permanent display such as trade shows and conventions and stores, and particularly a portable folding truss system having locking wall members and locking hinge elements.

An apparatus in accordance with the principles of the present invention includes a foldable truss member including a plurality of adjacently connected side members together forming a peripheral boundary of the truss member. Each side member including an elongated support member having a side surface and a bridging member hingedly connected to the side surface of the support member at an attachment point of the support member. The bridging member having an extension at an edge of the bridging member opposite the attachment point. The side member also includes a plurality of hinge members pivotally joining the bridging member to the support member and an adjacent side member. Each hinge member allowing relative rotation of the side members.

Other embodiments of a system in accordance with the principles of the invention may include alternative or optional additional aspects. One such aspect of the present invention is that each bridging member also includes a sawtooth-shaped member having a first and second set of oppositely disposed peaks. The first set of peaks hingedly attached to the attachment point of the support member. The extensions of each bridging member including the second set of peaks.

Another aspect of the present invention is that the hinge members include surfaces frictionally engaging the bridging members.

Another apparatus in accordance with the principles of the present invention includes a foldable truss member including a plurality of adjacently connected side members together forming a peripheral boundary of the truss member. Each side member including an elongated support member having a side surface and a bridging member hingedly connected to the side surface of the support member at an attachment point of the support member. The bridging member having an extension at an edge of the bridging member opposite the attachment point. The side member also including a plurality of hinge members pivotally joining the extension of each side member to a support member of an adjacent side member. Each hinge member allowing relative rotation of adjacent side members. A plurality of edges between adjacent side members define a plurality of corners of the truss member.

Another aspect of the present invention is that each bridging member also includes a sawtooth-shaped member having a first and second set of oppositely disposed peaks. The first set of peaks hingedly attached to the attachment point of the support member and the extensions of each bridging member comprising the second set of peaks.

Another aspect of the present invention is that the hinge members include surfaces frictionally engaging the bridging members. Another apparatus in accordance with the principles of the present invention includes a foldable truss member including a plurality of side member means. Each side member means including a receiving means located at a lower edge of the side member means. The side member means adjacently arranged so that the lower edges of the adjacently arranged side member means form a closed shape having a plurality of corners. The side member means also including a plurality of hinging means connecting adjacently arranged side member means. The hinging means allowing relative rotation between adjacently arranged side member means so that the side member means are foldable into a substantially flat assembly.

Another aspect of the present invention is that the truss member also includes bridging means hingedly connecting at least two side member means.

Another aspect of the present invention is that the bridging means include a sawtooth-shaped member having a first and second set of oppositely disposed peaks. The first set of peaks hingedly attached to the attachment point of the side member means and the extensions of each bridging means hingedly connecting the second set of peaks to an adjacent side member means.

Another aspect of the present invention is that the hinge means include surfaces frictionally engaging the bridging means and the hinge means are fixedly connected to the side member means.

Another apparatus in accordance with the principles of the present invention includes a foldable truss member including a plurality of side member means each including a lower edge and two side edges. The side member means adjacently arranged so that the lower edges of the adjacently arranged side member means form a closed shape. The side member means also include a plurality of hinging means connected between the side edges of the adjacently arranged side member means. The hinging means allowing relative rotation between adjacently arranged side member means so that the side member means are foldable into a substantially flat assembly. The side edges of the side member means defining a plurality of corners of the truss member.

Another aspect of the present invention is that the truss member also includes bridging means hingedly connecting at least two side member means.

Another aspect of the present invention is that the bridging means include a sawtooth-shaped member having a first and second set of oppositely disposed peaks. The first set of peaks hingedly attached to the attachment point of the side member means and the extensions of each bridging means hingedly connecting the second set of peaks to an adjacent side member means.

Another aspect of the present invention is that the hinge means include surfaces frictionally engaging the bridging means and the hinge means are fixedly connected to the side member means.

A method in accordance with the principles of the present invention includes a method of assembling a truss member including adjacently coupling a plurality of side members to form a peripheral boundary for each of the truss members. Each of the side members including an elongated edge hingedly attached to a bridging member. The bridging members hingedly attached to adjacent side members. The method also includes relatively rotating side members and the bridging members to place the side members of the truss member in a deployed configuration.

Another aspect of the present invention is that the method also includes relatively rotating the adjacent side members about the elongated edges with a folding force sufficient to overcome the holding force of a plurality of hinge members and rotating the side members to put the truss member in a folded configuration.

Another aspect of the present invention is that the method also includes at least two adjacent side members are hingedly connected together via a plurality of hinge members connecting the side members to a bridging member.

A method in accordance with the principles of the present invention includes a method of assembling a truss member including adjacently coupling a plurality of side members to form a peripheral boundary for each of the truss members. Each of the side members including an elongated edge hingedly attached to an adjacent side member. The elongated edges of the side members defining a plurality of corners of the truss member. The method also including rotating the adjacent side members about the elongated edges to put the side members of the truss member in a deployed configuration and rotating the side members to overcome a holding force in the deployed configuration of the truss member to prevent further relative rotation of the side members.

Another aspect of the present invention is that the method also includes relatively rotating the side members to overcome a folding force sufficient to overcome the holding force of a plurality of hinge members and rotating the adjacent side members to place the truss member in a folded configuration.

Another aspect of the present invention is that the method also includes adjacent side members are connected via a plurality of hinge members which connect a plurality of bridging members between adjacent side members.

The foregoing objects, advantages and distinctions of the invention, among others, are obtained in a presently preferred construction that provides a portable foldable truss system having locking wall members and locking hinge elements.

These and various other advantages and features of novelty which characterize the invention are pointed out with particularity in the claims annexed hereto and form a part hereof. However, for a better understanding of the invention, its advantages, and the objects obtained by its use, reference should be made to the drawings which form a further part hereof, and to accompanying descriptive matter, in which there are illustrated and described specific examples of an apparatus in accordance with the invention.

BRIEF DESCRIPTION OF THE DRAWINGS

Referring now to the drawings in which like reference numbers represent corresponding parts throughout.

Figure 1:
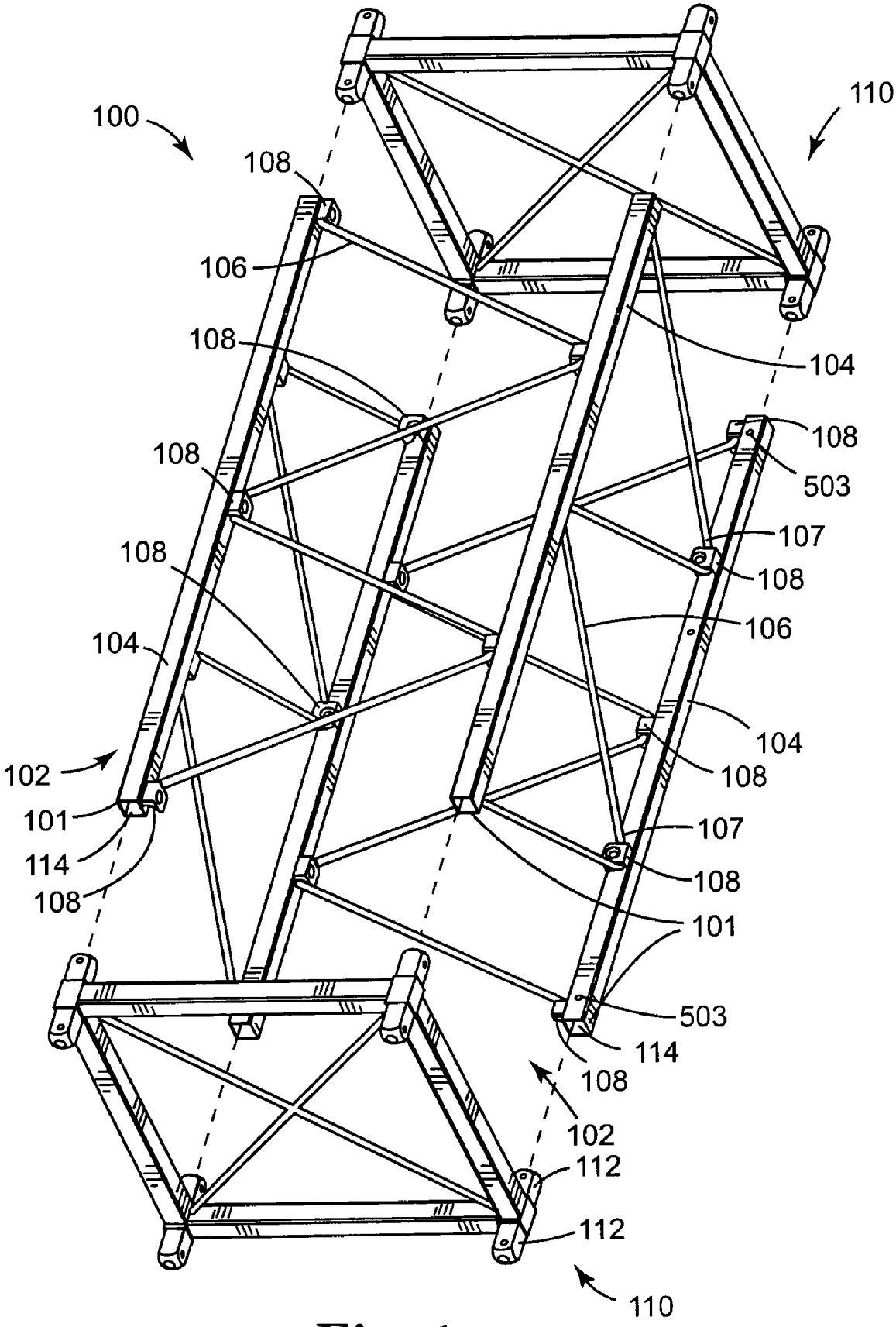
FIG. 1 illustrates a perspective view of a foldable truss according to an embodiment of the present invention.

While the invention is amenable to various modifications and alternative forms, specifics thereof have been shown by way of example in the drawings and will be described in detail herein. It is to be understood, however, that the intention is not to limit the invention to the particular embodiments described. On the contrary, the invention is intended to cover all modifications, equivalents, and alternatives falling within the scope of the invention as defined by the appended claims.

DETAILED DESCRIPTION OF THE INVENTION

In the following description of the illustrated embodiments, references is made to the accompanying drawings which form a part hereof, and in which is shown by way of illustration, various embodiments in which the invention may be practiced. It is to be understood that other embodiments may be utilized, and structural and functional changes may be made without departing from the scope of the present invention.

The present invention discloses a portable support structure for use in a temporary or permanent display such as trade shows and conventions and stores, and particularly a portable folding truss system having locking wall members and locking hinge elements.

FIG. 1 illustrates a perspective view of a foldable truss according to an embodiment of the present invention. In FIG. 1, a truss member 100 includes a plurality of side members 102. The side members 102 are adjacently connected to form a peripheral boundary of the truss member 100 such that the lower edges 101 of the side members 102 form a closed shape such as a rectangle or a square. The side members 102 include a support member 104 and a bridging member 106 connected by hinge members 108. The bridging members 106 are formed of a continuous length of tubular material formed into a generally planar sawtooth or V-shape. The bridging members 106 include one or more extensions 107 located at an edge opposite where the bridging members 106 join the support members 104. The extensions 107 are located at distal angular corners of the sawtooth shape. The truss member 100 is formed by joining multiple side members 102 and bridging members 106 using a plurality of hinge members 108.

The hinge members 108, shown in FIG. 1, are fixed to each support member 104 and pivotally join the bridging members 106 to adjacent support members 104. The hinge members 108 allow relative rotation of adjacent side members 102 while preventing the adjacent side members 102 from separating. As illustrated in FIG. 1, the truss member 100 contains four, pivotable, side members 102, thereby allowing the truss member 100 to be folded substantially flat for storage and shipment.

The hinge members 108 can be configured to hold the truss member 100 in a deployed configuration. In a deployed configuration, the side members 102 are rotated to an orientation so that the truss member 100 takes on the shape desired for the intended installation. Typically, this shape is a rectangle or square (as exemplified in FIG. 1) although it may be desired to make the deployed shape a parallelogram, triangle, or other polygon. The hinge member 108 may include locking or frictional features that retain the side members 102 in position once the side members 102 are oriented in the deployed configuration. Details of the locking and/or frictional features of the hinge members 108 will be described at a later point herein below.

The foldable truss member 100 may also be made to form a rigid support structure through use of a locking frame 110 or by other means such as cross member braces detailed elsewhere herein. The locking frame 110 is a rigid assembly with locking members 112 that interface with two or more support members 104 of the truss member 100 in a deployed configuration. The example shown in FIG. 1 shows a square or rectangular locking frame 110 with a locking member 112 at each corner.

The locking members 112 interface with receiving ends 114 of the support members 104. The locking members 112 are inserted into the receiving ends 114 to retain the truss member 100 in the deployed orientation. The receiving ends 114 may be formed as recesses or open ends of the support members 104. The locking members 112 typically extend from a top and bottom side of the locking frame 110, enabling multiple truss members 100 to be assembled end-to-end into a rigid support structure.

It is appreciated that alternate forms of a locking frame 110 can be used with a truss member 100 according to the present invention. Alternate structural elements known in the art can used to couple two or more side members 102 to make the truss member 100 rigid. For example, the locking frame 110 can be fabricated of a plate material having protruding locking members 112, or as a bar with two locking members 112 at each end. The locking members 112 can be made to encompass the receiving ends 114 and thereby allow the use of solid support members 104.

Figure 2:
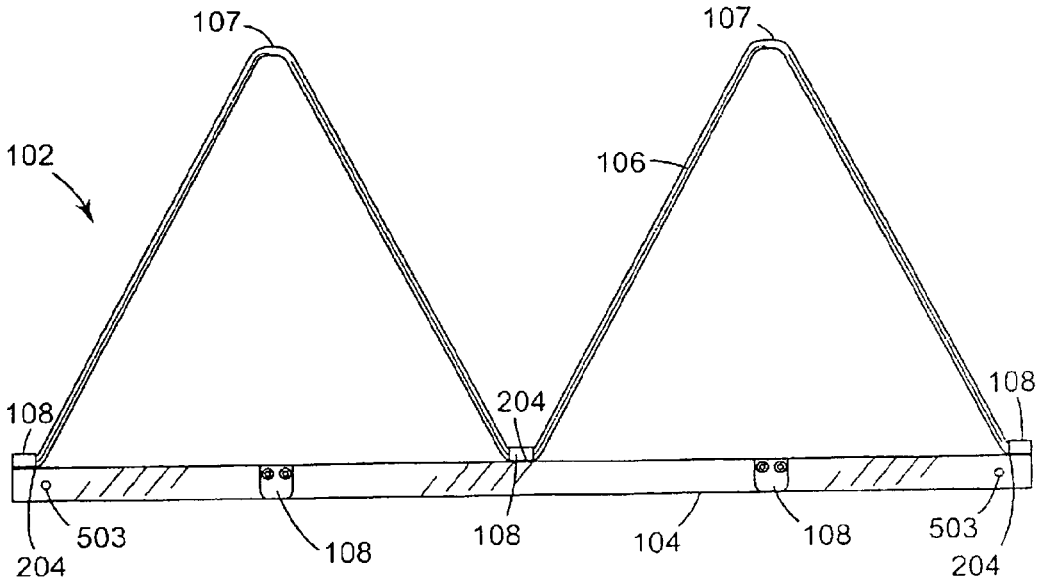
FIG. 2 illustrates a side view of a side member according to an embodiment of the present invention.

Turning now to FIG. 2, a side view of an embodiment of a side member 102 is shown. The truss member 100 is formed by adjacently connecting a plurality of side members 102 to form the outer walls of the truss member. Note that the side members 102 may be made substantially identical. Not only does this reduce the number of fabricated parts required to manufacture the truss member 100, it is also appreciated that a truss member 100 utilizing substantially identical side members will have symmetric transverse load characteristics (i.e. loads that are perpendicular to the longitudinal axis of the truss member). This makes such a truss member 100 ideal for horizontal installations, as there is no need for a preferred orientation of the side members 102.

The side member 102 is formed by attaching a bridging member 106 to a support member 104 with hinge members 108. The support member 104 is preferably formed from a tubular material, although it need not be hollow. Any cross-sectional shape of the support member 104 is appropriate, although a rectangular, square, or round cross sectional shape is typically the most useful. The illustrated support member 104 is formed from a square tube material.

The bridging member 106 is fixed to one side of the support member 104 at attachment points 204 with hinge members 108. The bridging member 106 can be tubular or a bar member bent into a sawtooth shape and attached with hinge members 108 to the support member 104. It is appreciated that the bridging member 106 can alternatively be formed from various elements, including a pattern cut from a sheet material or any elongated member (e.g. bar) formed into the desired shape. Further, although the bridging members 106 and other truss member components are typically made from metals (e.g. steel, aluminum, copper, brass, zinc, etc), the components can also be made alternate materials such as woods, plastics, carbon fiber, corrugated cardboard and composite materials.

The bridging member 106 includes extensions 107 that interface with hinge members 108 of an adjacent side member 102. The hinge members 108 are attached to the support member 104 at a location on the support member 104 generally in alignment with the bridging member extensions 107. The hinge members 108 are typically removably, as opposed to being permanently attached, thereby making assembly easier and allowing for assembly, disassembly, and re-assembly of the truss member 100 as desired.

Figure 3A:
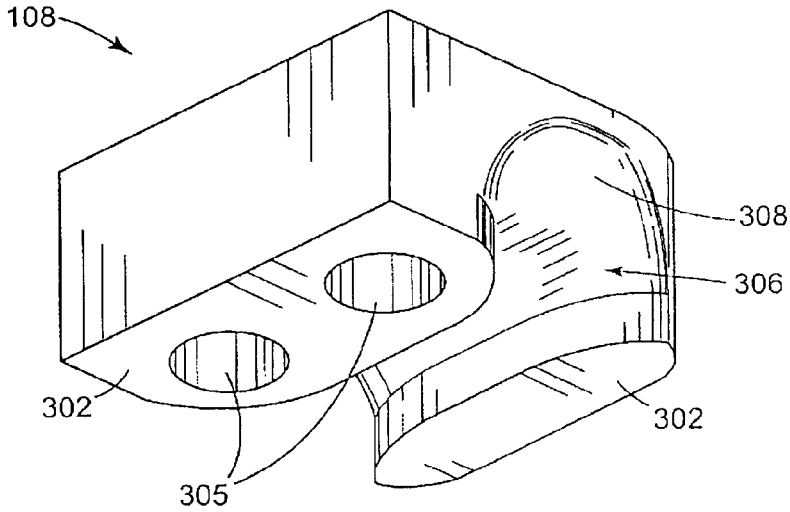
FIG. 3A illustrates a perspective view of a hinge member according to an embodiment of the present invention.

FIG. 3A shows an embodiment of an attachable hinge member 108. The hinge member 108 includes a mounting surface 302 with mounting holes 305. The mounting holes 305 align with holes on the support member 104 (not shown). The mounting holes 305 are adapted to receive fasteners, such as bolts, screws, rivets, locking pins, etc. The hinge member 108 includes a hinge channel 306 for receiving the extension 107 of a bridging member 106 therethrough. The hinge channel 306 is disposed through a portion of the mounting surface 302 and includes flared ends 308 that allow a generally curved extension 107 to freely rotate through 180 degrees within the hinge channel 306.

Figure 3B:
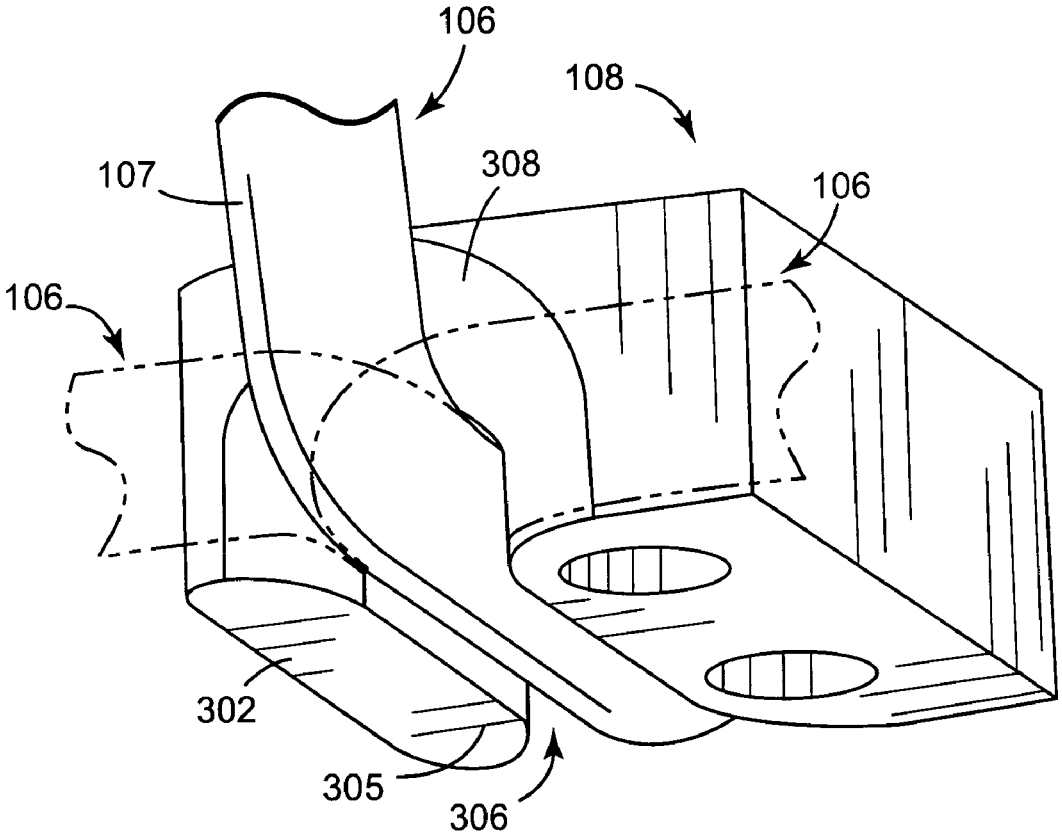
FIG. 3B illustrates a perspective view of the hinge member interacting with a bridging member extension according to an embodiment of the present invention.

The hinge member 108 may include features that allow the truss member 100 to maintain its deployed configuration during installation. These features are detailed in FIGS. 3B and 3C. In FIG. 3B, a portion of a bridging member 106 is shown in solid line with the extension 107 located within the hinge channel 306 oriented in a typical deployed configuration of the truss member 100. The orientations of the bridging member 106 corresponding to the folded configurations of the truss member 100 are shown using broken lines. Between the orientations illustrated are intermediate configurations, where the bridging member 106 is located when truss member 100 is being folded or deployed. In one embodiment, the hinge member 108 includes features that hold the extension 107 in a deployed configuration by using either friction and/or elastic deformation of the extension 107 to resist rotation of the bridging member 106.

Figure 3C:
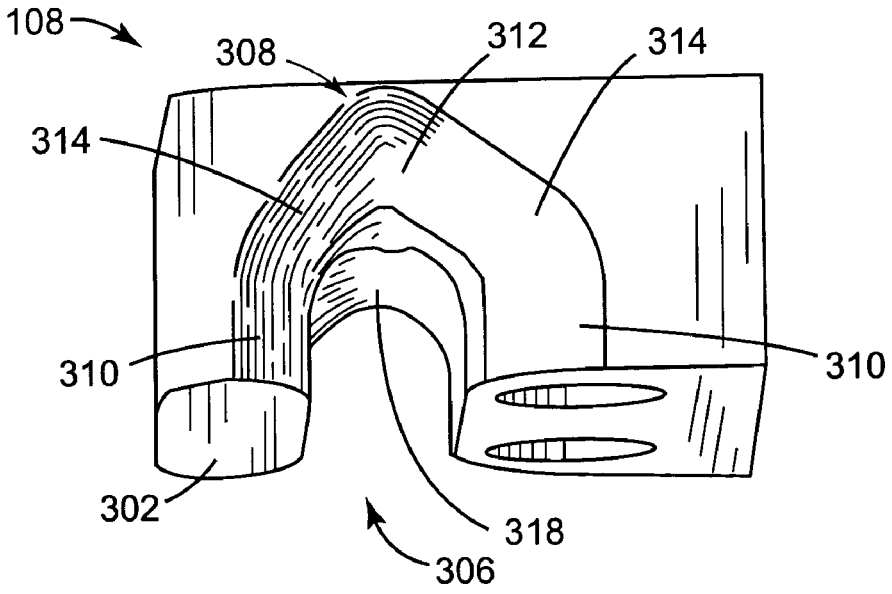
FIG. 3C illustrates a perspective view of an alternate hinge member illustrating locking features according to an embodiment of the present invention.

An example of hinge features that resist rotation of the bridging member 106 are shown in FIG. 3C. In FIG. 3C, the flared end 308 of the hinge channel 306 includes three portions of differing geometry. These portions include one or more terminal portions 310, a center portion 312 and one or more intermediate portions 314. These portions 310, 312, 314 correspond to the orientation of the extension 107 within the hinge member 106 when the truss member 100 is in the folded, deployed, and intermediate configurations, respectively. The terminal portions 310 are designed to offer little or no interference with the extension 107, thereby allowing easy rotation of side members 102 in the folded configuration. The intermediate portions 314 offer varying resistance where the intermediate portions 314 are adjacent the center portion 312. The center portion 312 typically offers some resistance to rotation of the extension 107, although preferably less resistance than the intermediate portions 314. Having less resistance at the center portion 312 gives the user feedback that the truss member 100 has attained the deployed configuration, because the extensions 107 will "snap" into the center portion 312.

The portions 310, 312, 314 of the hinge member 108 can offer changing resistance to rotation of the extension by various means. In the example of FIG. 3C, the portions 310, 312, and 314 are formed by fillets or small grooves that form the hinge channel 308. It is appreciated that forming a fillet radius different than the inner bend radius of the extension 107 will cause the fillets to ride or rub (frictionally interfere) at contact points against portions of the extension 107. Also, the portions 310, 312, 314 of the hinge member 108 are arrayed generally radially about a rounded portion 318 of the hinge channel 306. The rounded portion 318 has a substantially constant semicircular profile throughout the hinge channel 306 in order to effectively restrain the side members 102 during deployment of the truss member 100. The portions 310, 312, 314 of the hinge member 108 may have varying shapes and be located at varying radial distances from the rounded portion 318 in order to increase or decrease interference with the extension 107. For example, as shown in FIG. 3C, the intermediate portions 314 are located radially closer to the rounded portion 318 than the other portions 310, 312 and are somewhat flattened, thereby giving the flared end 308 a peaked appearance. In this way, the intermediate portion 314 causes an increase in friction and/or elastic deformation of the extension 107, thereby resisting rotation of the extension 107.

Truss members 100 may be constructed that have a large number of extensions 107 along the side members 102. In this case, it may be desirable to include a mixture of hinge members 108 alternately configured according to both the configurations shown in FIG. 3A and FIG. 3C. This allows the folding action of the truss assembly 100 to be "tuned", so that holding forces are not excessive.

A truss member 100 may be assembled by locating the extensions 107 of a first side member 102 within the channels 306 of associated hinge members 108. The associated hinge members 108 are then attached to the support member 104 of a second side member 102, trapping the extensions 107 of the first side member 102 between the associated hinge members 108 and the support member 104 of the second side member 102. This process is repeated for all side members 102 so the side members 102 form a closed periphery.

Figure 4:
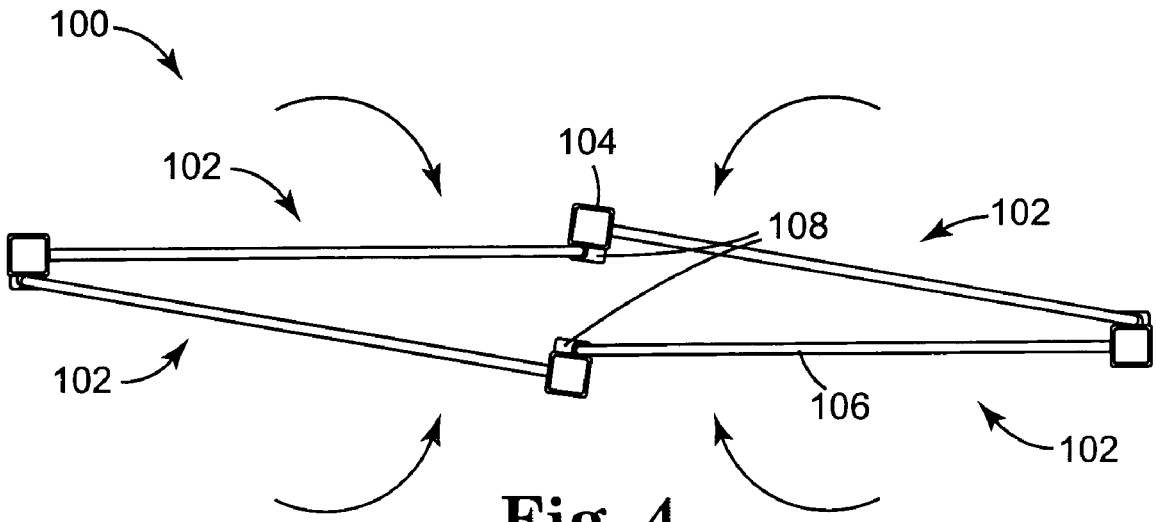
FIG. 4 illustrates an end view of the foldable truss member showing a partially folded configuration according to an embodiment of the present invention.

After assembly, the truss member 100 can be expanded for use or folded into a substantially flat folded configuration for storage or transport. FIG. 4 illustrates an end view of a partially folded truss member 100. The truss member 100 is folded by moving the side members 102 in the directions indicated by the curved arrows in FIG. 4. While being folded, the adjacent side members 102 rotate relative to each other at the edges of the side members 102 joined by the hinge members 108. Expanding the truss member 100 to the deployed configuration involves moving the side members 102 in directions opposite those indicated by the curved arrows and installing a locking frame 110 to retain the truss member in the deployed orientation.

Figure 5:
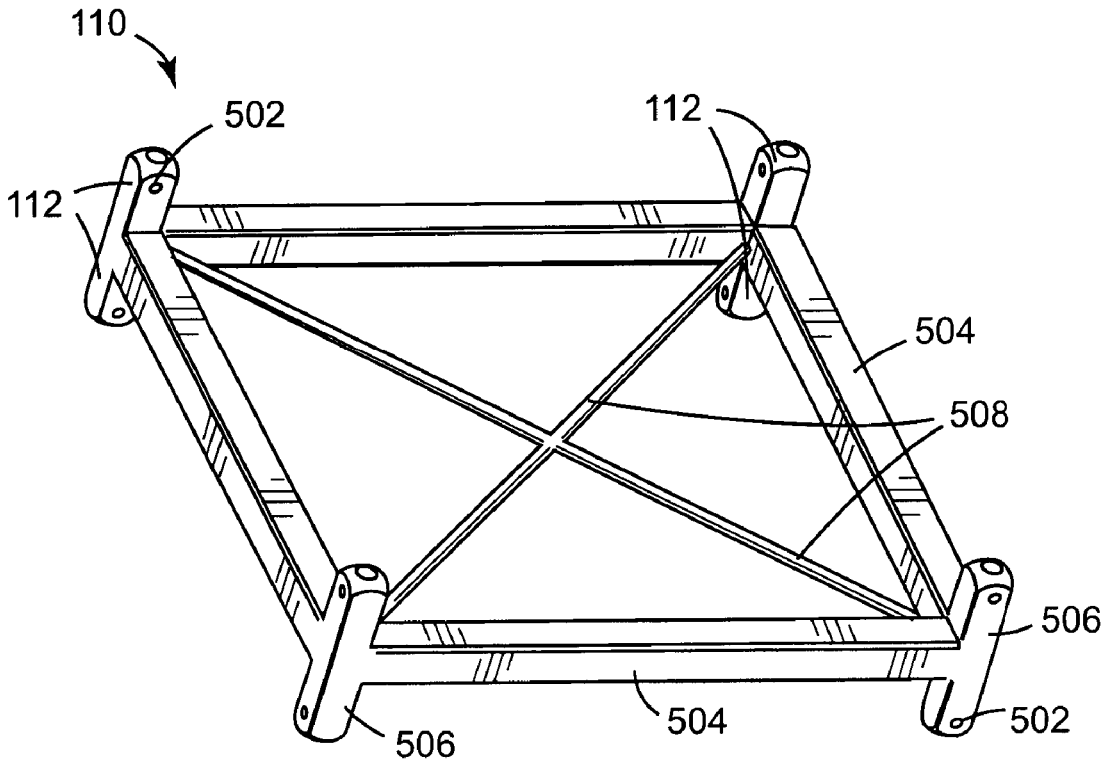
FIG. 5 illustrates a perspective view of a locking frame according to an embodiment of the present invention.

FIG. 5 shows details of the locking frame 110 used to achieve rigidity of the assembled truss member 100. The locking frame 110 in FIG. 5 is a rigid frame having four sides 504 and four corners 506. Cross bracing 508 may be included for added strength. The locking members 112 in this embodiment are formed as posts that protrude generally perpendicular to a plane defined by the four sides 504. The locking frame 100 is attached by inserting the locking members 112 of the locking frame 110 into the receiving ends 114 of the truss member 100. Locking holes 502 are included in the locking members 112. The locking holes 502 align with locking holes 503 on the support members 104 (best seen in FIGS. 1 and 2). An interference member (not shown) can be passed through holes 502, 503 to lock the truss member 100 to the locking frame 110.

Figure 6:
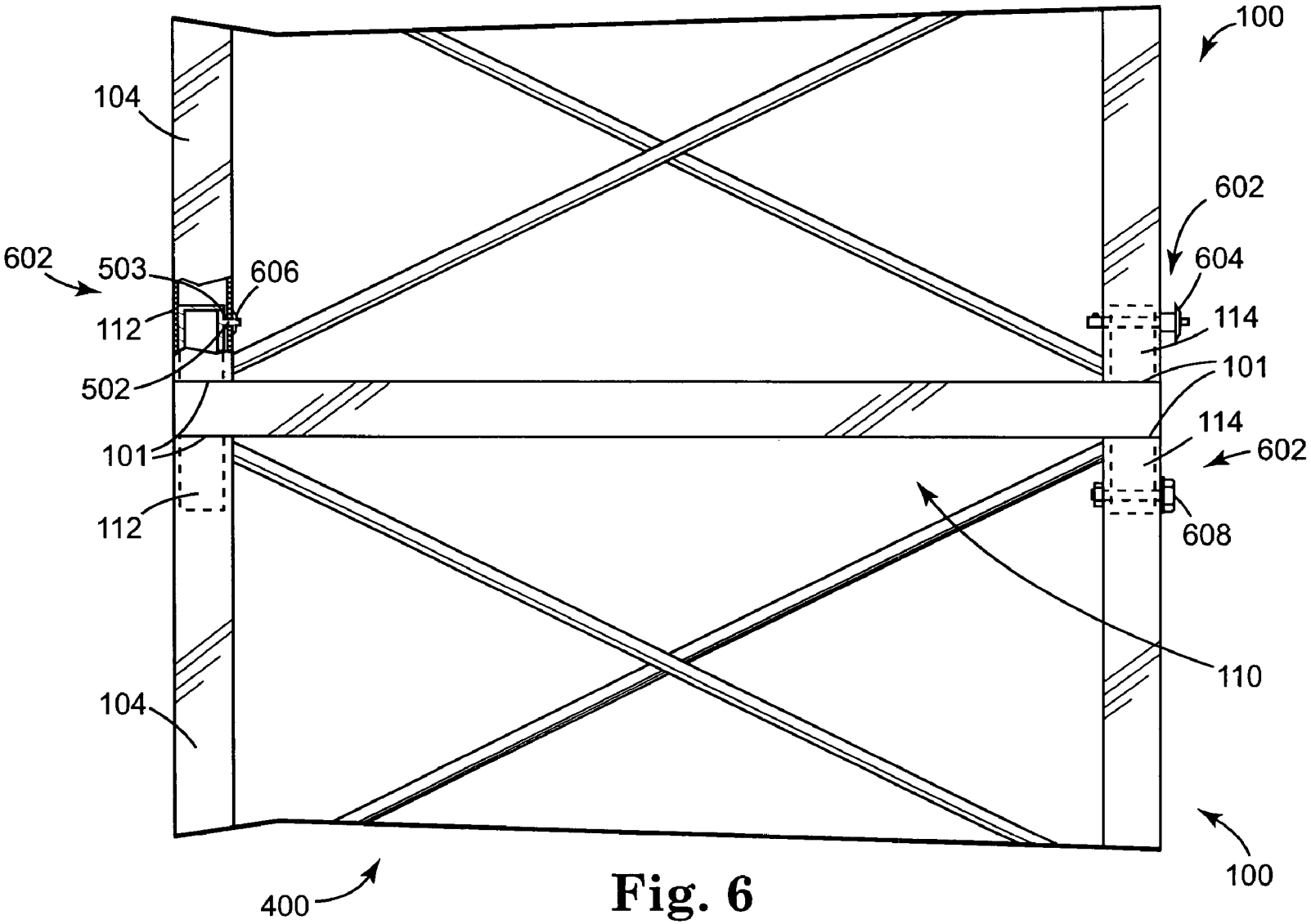
FIG. 6 illustrates a partial side view of a display structure according to an embodiment of the present invention.

FIG. 6 is a partial view of a display structure 400 created by connecting two truss members 100 to a locking frame 110. The first and second truss members 100 are expanded to the deployed configuration. The locking frame 110 is inserted into the receiving ends 114 on the lower edges 101 of the first truss members 100. The second truss member 100 is similarly attached to the locking frame 110 and thereby rigidly coupled to the first truss member 100.

A fastening member (e.g. interference member) 602 can be used to create a positive locking engagement between the locking frame 110 and the truss members 100. The mounting holes 502, 503 are aligned such that fastening members 602 can be placed through the holes 502, 503. In this example, exemplary fastening members 602 include a quick release pin 604, a welded locknut/screw assembly 606 and a nut/bolt assembly 608. Other fastening members 602 such as clips, rivets, wire ties, snaps, latches, clamps, and etc., may also be used to fasten the truss members 100 and the locking frames 110.

In some display structures 400, the truss members 100 have sufficient strength to preclude the need for a locking member 110 at every junction. At those junctions, the display structure 400 may be connected by placing independent (i.e. not interconnected) locking members 112 between the receiving ends 114. Independent locking members 112 may also be fixed with fastening members 602, as described herein above.

The truss member 100 and display structure 400 according to the present invention can be beneficially be adapted for all manner of structural uses, particularly those of a temporary or seasonal nature. In particular, one such configuration desirable for uses such as displays or point of sale fixtures is described herein in detail. A truss member 100 having approximately 12"×12" cross sectional dimensions is preferable in these applications. The individual truss member lengths can vary from about 6" to about 80". The support members 102 are formed from ¾" to 1" square steel tubing welded to 3/16" wire lacing forming the bridging members 106. The hinge members 108 are investment cast from steel and finished with a smooth finish along the hinge channel surfaces 306. Fabricating the truss assembly 100 from steel offers advantages of low cost, high strength, and magnetic properties for easy attachment of magnetic graphics. The steel is typically powder coated for appearance and corrosion resistance. The support members can be of different sizes and of different materials than stated above, such as round tubes and plastics, aluminum or other materials with sufficient strength. In general, the strength of coupled truss members 100 in this specific application should be able to be safely used over a 40 foot span with no load. Loads up to a few hundred pounds can be supported either applied centrally or distributed. Such load bearing capability would enable the truss to safely support item such as computer or TV monitors, lights and signage, typically used in an exhibit/display. The weight of the truss member 100 so configured will range from ½ pound to 10 lbs for truss lengths between 6" and 80".

The foregoing objects, advantages and distinctions of the invention, among others, are obtained in a presently preferred construction that provides a portable support structures for use in temporary fixtures such as trade shows and conventions, and particularly to a portable folding truss system having hinging side elements.

The foregoing description of the exemplary embodiment of the invention has been presented for the purposes of illustration and description. It is not intended to be exhaustive or to limit the invention to the precise form disclosed. Many modifications and variations are possible in light of the above teaching. It is intended that the scope of the invention be limited not with this detailed description, but rather by the claims appended hereto.

What is claimed is:

1. A foldable truss member comprising:

a plurality of adjacently connected side members together forming a peripheral boundary of the truss member, each side member comprising:

an elongated support member having a side surface;

a bridging member hingedly connected to the side surface of the support member at an attachment point of the support member, the bridging member having an extension at an edge of the bridging member opposite the attachment point; and a plurality of hinge members pivotally joining the extension of each side member to a support member of an adjacent side member, each hinge member having surfaces frictionally engaging the bridging members and a channel for said bridging member and wherein said support member forms a pad of the hinge together with said channel which captures said bridging member, thereby allowing relative rotation of adjacent side members, a plurality of edges between adjacent side members defining a plurality of corners of the truss member.

2. A foldable truss member, comprising:

a plurality of side members each having at least four sides including two adjacent side edges, the side members adjacently arranged so that the side edges of the four adjacently arranged sides define a closed shape; and a plurality of hinges affixed to each of the two adjacent edges of each side member, the hinges allowing relative rotation between adjacently arranged side members so that the side member means are foldable into a substantially flat assembly, the side edges of the side member means defining a plurality of corners of the truss member, wherein the hinges comprise surfaces frictionally engaging the bridges, and the hinges are fixedly connected to the side members.

3. A method of operating a foldable truss member capable of moving from a substantially flat to an open deployed position, comprising:

adjacently bridging a plurality of side members to form a peripheral boundary for each of the truss members, each of the side members including an elongated edge hingedly attached to an adjacent side member, the elongated edges of the side members defining a plurality of corners of the truss member;

rotating the adjacent side members about the elongated edges to put the side members of the truss member in a deployed configuration; and creating a variable rotational resistance between said side members so that it is necessary to overcome a holding force when said truss member is in a deployed position and is being moved toward a folded position, to generally maintain said truss in a deployed position.

4. A foldable truss member moveable between a substantially folded and open deployed positions, comprising:

a plurality of adjacently connected side members together forming a peripheral boundary of the truss member, each side member comprising:

an elongated support member having a side surface;

a bridging member hingedly connected to the side surface at an attachment point of the support member, a plurality of hinge members pivotally joining the bridging member to the support member and an adjacent side member, each hinge member allowing relative rotation of the side members at least one of said hinge members having a center portion configured to tend to maintain said bridging member in a position corresponding to the deployed position of said truss member by virtue of said hinge member providing less resistance to rotation in said center portion and greater resistance to rotation elsewhere, so that when said truss system is deployed, it will tend to stay In a deployed state.

5. The truss member according to claim 4, wherein the hinge members comprise surfaces frictionally engaging the bridging members and wherein said frictional engagement is variable across said hinge member's surface.

6. The truss member according to claim 4, wherein the hinge members comprise a block member affixed to said support member having a channel therethrough, said channel being sized to frictionally receive a movable bridging member.

7. The truss member according to claim 4, wherein the block member includes a channel for said bridging member and where said channel includes at least one filleted inner surface which contacts said bridging member.

8. The truss member according to claim 7 wherein said channel includes predetermined bend radius, and where said bridging member includes a curved portion sized to be received within said channel and having a predetermined bend radius different from said channel radius, thereby creating frictional interference between said channel and said bridging member.

9. The truss member according to claim 4, wherein the block member includes a generally U-shaped channel for said bridging member and where said channel is radiused to provide rotational resistance between said channel and said bridging member.

10. The truss member according to claim 4 wherein said block member includes a hinge channel therethrough and plurality of surfaces along said channel including a central surface and a flared surface.

11. The truss member according to claim 10 wherein said flared surface includes a partially flattened region positioned such that, when said truss is in its deployed state, said a portion of said bridging member will be urged into said partially flattened region.

12. The truss member according to claim 4 wherein block includes a channel having an inner surface and at least one side surface extending from said channel, and wherein said side surface has a trough section and flared sections on either side thereof, and wherein said side surface is configured to urge said bridging member into said trough when in said deployed state.

13. The truss member according to claim 4 wherein said trough section and said bridge member are configured to provided feedback resistance whenever said truss is moved from a deployed state toward a folded state.

14. The truss member according to claim 4 wherein said hinge members include primary hinge members and secondary hinge members, said primary hinge members configured to urge said bridging members to a position corresponding to the deployed position of said truss member, and said secondary hinge member being free swinging.

15. The truss member of claim 14 wherein said primary and secondary hinge members are apportioned to tune the deployment force of said hinge members.

16. The truss member of claim 14 wherein said primary and secondary hinge members are commingled on the truss member to permit adjustment of deployment force of said hinge members.

17. A foldable truss member moveable between a substantially folded and open deployed positions, comprising:

a plurality of adjacently connected side members together forming a peripheral boundary of the truss member, each side member comprising:

an elongated support member having a side surface;

a bridging member hingedly connected to the side surface at an attachment point of the support member, at least one hinge member pivotally joining the bridging member to the support member and an adjacent side member, said hinge member allowing relative rotation of the side members said at least one hinge member having a center portion being configured to tend to maintain said bridging member in a position corresponding to the deployed position of said truss member by virtue of said member providing less resistance to rotation in said center portion and greater resistance to rotation elsewhere, so that when said truss system is deployed, it will tend to stay in a deployed state.

18. A foldable truss member moveable between a substantially folded and open deployed positions, comprising:

a plurality of adjacently connected side members together forming a peripheral boundary of the truss member, each side member comprising:

an elongated support member having a side surface;

a bridging member hingedly connected to the side surface at an attachment point of the support member, at least one first and second hinge members pivotally joining the bridging member to the support member and an adjacent side member, said hinge member allowing relative rotation of the side members said at least one first hinge member having a center portion being configured to tend to maintain said bridging member in a position corresponding to the deployed position of said truss member by virtue of said hinge member providing less resistance to rotation in said center portion and greater resistance to rotation elsewhere so that when said truss system is deployed, it will tend to stay in a deployed state and said at least one second hinge member being substantially free-swinging.

* * * * *